US008785098B2

(12) United States Patent
Takahashi et al.

(10) Patent No.: US 8,785,098 B2
(45) **Date of Patent: *Jul. 22, 2014**

(54) TRANSPARENT TONER FOR ELECTROSTATIC LATENT IMAGE DEVELOPMENT, METHOD FOR PRODUCING THE SAME, ELECTROSTATIC LATENT IMAGE DEVELOPER, TONER CARTRIDGE, PROCESS CARTRIDGE, AND IMAGE FORMING APPARATUS

(75) Inventors: Masaru Takahashi, Kanagawa (JP); Atsushi Sugawara, Kanagawa (JP); Yasuo Kadokura, Kanagawa (JP); Masanobu Ninomiya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1005 days.

This patent is subject to a terminal disclaimer.

(21) Appl. No.: 12/582,326

(22) Filed: Oct. 20, 2009

(65) Prior Publication Data

US 2010/0209835 A1 Aug. 19, 2010

(30) Foreign Application Priority Data

Feb. 13, 2009 (JP) ..... 2009-030921

(51) Int. Cl.
*G03G 9/087* (2006.01)

(52) U.S. Cl.
USPC ..... 430/109.4; 430/108.24; 430/108.8; 430/137.14

(58) Field of Classification Search
USPC ..... 430/109.4, 108.24, 108.6, 108.8, 430/137.14
See application file for complete search history.

(56) References Cited

U.S. PATENT DOCUMENTS

| | | | | |
|---|---|---|---|---|
| 5,384,224 | A * | 1/1995 | Tanikawa et al. | 430/108.8 |
| 6,284,421 | B1 * | 9/2001 | Matsuzaki et al. | 430/111.1 |
| 6,310,117 | B1 * | 10/2001 | Sawada et al. | 523/200 |
| 6,495,302 | B1 * | 12/2002 | Jiang et al. | 430/137.14 |
| 7,037,633 | B2 * | 5/2006 | Hopper et al. | 430/137.14 |
| 8,389,187 | B2 * | 3/2013 | Kadokura et al. | 430/108.8 |
| 2006/0040194 | A1 * | 2/2006 | Sugiura et al. | 430/108.4 |
| 2007/0087281 | A1 * | 4/2007 | Patel et al. | 430/110.2 |
| 2008/0199797 | A1 * | 8/2008 | Sacripante et al. | 430/104 |

FOREIGN PATENT DOCUMENTS

JP A-10-073952 3/1998

* cited by examiner

*Primary Examiner* — Jonathan Jelsma
(74) *Attorney, Agent, or Firm* — Oliff PLC

(57) ABSTRACT

The invention provides a transparent toner for electrostatic latent image development, containing a polyester resin and a release agent, the difference between an endothermic peak Tm of the release agent in a temperature increasing process and an exothermic peak Tc of the release agent in a temperature decreasing process when measured by an ASTM method with a differential scanning calorimeter (DSC) is from about 40° C. to about 50° C., and the degree of exposure of the release agent at the surface of the toner as determined quantitatively by X-ray photoelectron spectroscopy (XPS) is about 10% or less.

17 Claims, 2 Drawing Sheets

TRANSPARENT TONER FOR ELECTROSTATIC LATENT IMAGE DEVELOPMENT, METHOD FOR PRODUCING THE SAME, ELECTROSTATIC LATENT IMAGE DEVELOPER, TONER CARTRIDGE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2009-030921 filed on Feb. 13, 2009.

BACKGROUND

1. Technical Field

The present invention relates to a transparent toner for electrostatic latent image development, a method for producing the same, an electrostatic latent image developer, a toner cartridge, a process cartridge, and an image forming apparatus.

2. Related Art

A method of visualizing image information via an electrostatic latent image by an electrophotographic method has been utilized in various fields at present. In the electrophotographic method, image information is formed as an electrostatic latent image on the surface of a latent image holding member (photoreceptor) in charging and exposure steps, and then developed with a toner-containing developer to form a toner image on the surface of the photoreceptor, and the toner image is transferred onto a recording medium (transfer medium) such as paper in a transfer step and then fixed on the surface of the recording medium in a fixing step, thereby visualizing the image.

Formation of a color image by a color electrophotographic method that has dramatically become popular in recent years involves color reproduction generally with 4-color toners, that is, 3-color toners of subtractive primaries (yellow, magenta and cyan) plus a black toner.

In the general color electrophotographic method, an original manuscript (image information) is first subjected to color separation into yellow, magenta, cyan and black colors to form electrostatic latent images of the respective colors on the surface of a photoreceptor. On this occasion, electrostatic latent images formed for the respective colors are developed with developers containing toners of the respective colors to form toner images which are then transferred in a transfer step onto the surface of a recording medium. A series of steps from formation of an electrostatic latent image until transfer of a toner image onto the surface of a recording medium are performed in order for the respective colors so that toner images of the respective colors are superimposed in accordance with the image information and transferred onto the surface of a recording medium. In the transfer step, the toner images are transferred directly or via an intermediate transfer medium onto a recording medium.

In this manner, a colored toner image obtained by transferring toner images of the respective colors onto the surface of a recording medium is fixed in a fixing step as a color image.

In formation of these color images, not only the conventional Y (yellow), M (magenta), C (cyan) and BK (black) toners but also a transparent toner is used in attempting at correcting the in-plane gloss difference of an image, at regulating gloss on the surface of a transfer paper, or at correcting the density of an image and the amount of adhered toners.

SUMMARY

According to an aspect of the invention, there is provided a transparent toner for electrostatic latent image development, containing a polyester resin and a release agent, the difference between an endothermic peak Tm of the release agent in a temperature increasing process and an exothermic peak Tc of the release agent in a temperature decreasing process when measured by an ASTM method with a differential scanning calorimeter (DSC) is from about 40° C. to about 50° C., and the degree of exposure of the release agent at the surface of the toner as determined quantitatively by X-ray photoelectron spectroscopy (XPS) is about 10% or less.

BRIEF DESCRIPTION OF THE DRAWINGS

Exemplary embodiments of the invention will be described in detail based on the following figures, wherein.

DETAILED DESCRIPTION

Figure 1:
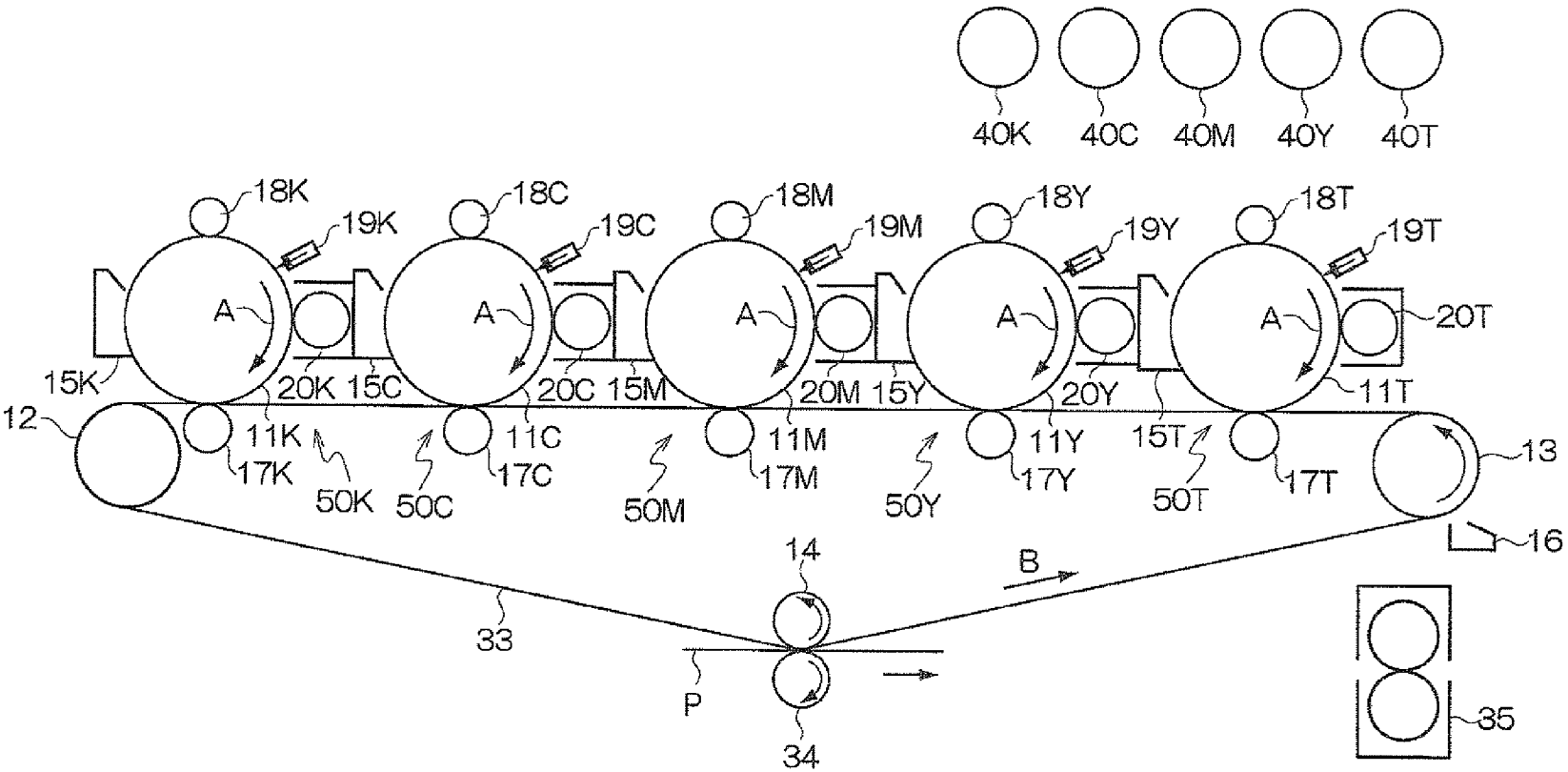
FIG. 1 is a skeleton framework showing one example of the image fowling apparatus in the exemplary embodiment of the invention.

Hereinafter, exemplary embodiments of the transparent toner for electrostatic latent image development, the method for producing the same, the electrostatic latent image developer, the toner cartridge, the process cartridge and the image forming apparatus according to the present invention will be described in detail.

<Transparent Toner for Electrostatic Latent Image Development>

The transparent toner for electrostatic latent image development in the exemplary embodiment (also referred to hereinafter as merely "toner") includes a polyester resin and a release agent, wherein the difference between an endothermic peak Tm of the release agent in a temperature increasing process and an exothermic peak Tc of the release agent in a temperature decreasing process by an ASTM method with a differential scanning calorimeter (DSC) is from 40 or about 40 to 50 or about 50° C., and the degree of exposure of the release agent at the surface of the toner as determined quantitatively by X-ray photoelectron spectroscopy (XPS) is 10% or less or about 10% or less.

In the exemplary embodiment, the transparent toner is a toner used in transparent toner images and refers specifically to a nearly transparent toner wherein the content of colorant such as a dye or a pigment is 0.01% by weight or less or about 0.01% by weight or less.

When the difference between Tm and Tc is less than 40° C., it is indicated that the crystallinity of the release agent is high (as the release agent is cooled, it is easily crystallized). When the difference is 40° C. or more, it is indicated that the release agent is poor in crystallinity upon cooling (even if the release agent is cooled, it is hardly crystallized), and that there are some factors for preventing crystallization.

In the conventional colored toner such as cyan toner, magenta toner, yellow toner or black toner, a release agent is not made compatible with a binding polymer and a colorant in the toner, regardless of its production method such as kneading milling, emulsion aggregation (EA) or suspension polymerization. Accordingly, the crystallinity of the release agent is not deteriorated. When the toner is measured with DSC, the Tm (endothermic peak) and Tc (exothermic peak) attributable to the release agent are almost the same. When the Tm and Tc are closed to each other, the release agent melted by heating is liable to growth of crystals upon cooling. When crystals of the release agent grow, the crystals of the release agent become flat in shape.

When crystals of the release agent grow, the crystals of the release agent become flat in shape in a transparent toner similar to a colored toner. Particularly, when a fixed image is gradually cooled, crystals of the release agent in the fixed image grow, so that the domain of the release agent is increased in size, while the domain of the release agent easily becomes flat in shape. Light is reflected on the surface of a fixed image of the colored toner, so uneven gloss will not occur regardless of the crystal shape of the release agent. In the case of the transparent toner, however, light passes through its transparent fixed image and is reflected by the release agent in the transparent toner or on the surface of a paper (transfer medium) on which the transparent toner is fixed. When the crystals of the release agent in the transparent toner are flat in shape, light is diffusely reflected so that when the toner density is high, uneven gloss may be generated.

Even if the transparent toner in the invention described in JP-A No. 10-73952 would be prepared without using a colorant, the crystallization of a release agent in a fixed image could not be suppressed by merely allowing branched carbon to be in a predetermined ratio as a method of suppressing growth of crystals in the release agent, and so the crystals of the release agent might become flat. For example, the difference between Tm and Tc of a transparent toner using FNP0090 (manufactured by Nihon Seirou Corp.) is 5° C., and when the release agent melted by heating is gradually cooled, the crystals of the release agent easily become flat in shape.

As a method of preventing the uneven gloss of a fixed transparent toner, there is a method of keeping the crystal shape of a release agent spherical in a fixed image in order to prevent diffused reflection of light by the release agent. However, crystals of a usual release agent have grown, so that there has conventionally been no method of preventing the release agent from growing crystals, thereby preventing the crystal shape from becoming flat. As a method of preventing crystal growth, there is a method of adding a crystallization inhibitor, however when a crystallization inhibitor is merely added, the crystallization inhibitor remains in a binding polymer, so that the effect of wax domain from the outside is expected. The crystal growth of wax occurs in every direction, and prevention of the crystal growth of wax from the outside is substantially difficult, and thus addition of the crystallization inhibitor is insufficient as a method of inhibiting uneven gloss.

In the exemplary embodiment, Tm and Tc are made different by 40 or about 40 to 50 or about 50° C., whereby the crystal growth of the release agent contained in the transparent toner is inhibited and regulated such that the crystal shape of the release agent does not become flat. By so doing, the uneven gloss of the fixed transparent toner is suppressed. Uneven gloss easily occurs in printing, particularly on a second face in double face printing. This is estimated due to the fact that in printing on a first face, a transfer medium heated in contact with a fixing member is subjected, while in hot, to printing on a second face, thereby allowing easy crystal growth of the release agent. When the toner in accordance with the exemplary embodiment is used, uneven gloss upon printing on a second face can be effectively prevented.

By inhibiting the crystal growth of the release agent, the release agent can be prevented from being exposed at the surface of the transparent toner. In the case of kneading milling, a clear interface between the release agent and the binding polymer is generated when the crystal growth of the release agent proceeds after the kneading step, so the easily broken interface of the release agent is exposed in the milling step. On the other hand, when crystal growth is prevented, the interface is hardly generated and thus the release agent is prevented from being exposed. In the case of chemical production processes such as emulsion aggregation (EA) and suspension polymerization, the affinity of the release agent for the binding polymer is increased by inhibiting the crystal growth of the release agent in the toner production process, thus increasing the amount of the release agent included in the toner, which would result in preventing the release agent from being exposed.

When a color toner image is formed by using colored toners such as yellow, magenta, cyan and black toners and a transparent toner, the transparent toner is allowed to be often present in the surface of the toner image for the purpose of improving the gloss of the image. Accordingly, in the color toner image primarily transferred onto an intermediate transfer medium, the transparent toner is contacted with the intermediate transfer medium. When the degree of exposure of the release agent at the surface of the transparent toner is high, the intermediate transfer medium made high-temperature by repeated image formation may be polluted with the release agent exposed at the surface of the transparent toner. As a result, the cleanability of an intermediate transfer belt may be deteriorated, and image defects such as white spots may be generated in fixed images.

In the transparent toner in the exemplary embodiment, the degree of exposure of the release agent is 10% or less or about 10% or less so that the pollution of an intermediate transfer medium with the release agent can be prevented. As a result, image defects such as white spots in the fixed image can be prevented.

When the difference between Tm and Tc is less than 40° C., the suppression of the crystallization of the release agent may be insufficient. To make the difference between Tm and Tc greater than 50° C. is technically difficult.

When the degree of exposure of the release agent at the surface of the toner is more than 10%, the cleanability of an intermediate transfer medium may be deteriorated. The degree of exposure of the release agent at the surface of the toner is preferably lower and is ideally preferably 0%.

The Tm and Tc based on the ASTM method (D3418-8) are those determined with a differential scanning calorimeter (DSC) by the following method: 1) 10 mg sample is placed in an aluminum cell and lidded (this is referred to as a sample cell). For comparison, 10 mg alumina is similarly placed in an aluminum cell of the same type and lidded (this is referred to as a comparative cell). 2) The sample cell and the comparative cell are set respectively in a measuring apparatus, then heated at an increasing temperature rate of 10° C./min. from 30° C. to 200° C. in a nitrogen atmosphere, and left at 200° C. for 10 minutes. 3) After being left, both the cells are cooled at a decreasing temperature rate of −10° C./min. to −30° C. in liquid nitrogen and then left at −30° C. for 10 minutes. 4) After being left, the cells are heated at an increasing temperature rate of 20° C./min. from −30° C. to 200° C. In the operation in 4), endothermic and exothermic curves are determined. From the endothermic and exothermic curves thus obtained, Tm and Tc are determined. As the measuring apparatus, a differential scanning calorimeter DSC-7 manufactured by Perkin Elmer Inc. was used.

Whether Tm and Tc in the obtained endothermic and exothermic curves are those derived from the release agent contained in the toner is judged in the following manner. First, the toner is dissolved in a solvent (for example toluene) heated at about 180° C. and then cooled, and the crystallized release agent only is obtained. An endothermic peak of the obtained release agent is obtained with DSC in the same temperature-increasing process as described above. If this endothermic peak agrees with the Tm of the toner, it can be judged that the Tm of the toner is derived from the release agent contained in the toner.

Then, the toner-dissolved toluene remaining after the release agent only was obtained therefrom is volatilized thereby removing the toluene, and the resulting solid residue is measured for its exothermic peak with DSC in the same temperature-decreasing process as described above. The obtained exothermic peaks are derived from materials other than the release agent, and thus it can be judged that the Tc of the toner, other than these peaks, is derived from the release agent.

In the exemplary embodiment, the method of making Tm and Tc different from each other by 40 to 50° C. is not particularly limited and includes, for example, a method of allowing a metal element such as Al to be contained in a domain of the release agent.

The degree of exposure of the release agent at the surface of the toner, as quantified by X-ray photoelectron spectroscopy (XPS), can be quantified by separating peaks attributable to the resin, the release agent and other additives with a measuring instrument such as an X-ray photoelectron spectrometric instrument manufactured by Nihon Denshi K.K.

In the exemplary embodiment, metal elements such as Al may be contained in the release agent domains of the toner. The metal elements such as Al function as a crystallization inhibitor for the release agent. Further, the metal elements such as Al have an effect of preventing the crystal growth of the release agent by ionic-bonding to a binding polymer in the toner. As a result, Tm and Tc are made different by 40 to 50° C. Uneven gloss can thereby be effectively prevented after fixation.

The metal element contained in the release agent domain is preferably Al because it has a high valence number and is effective in preventing crystallization by ionic bonding.

The method of allowing a metal element such as Al to be contained in the release agent domain will be described later.

Whether a metal element such as Al is contained in the release agent domain is confirmed by the following method. First, the toner particles are embedded in a mixture of bisphenol A liquid epoxy resin and a curing agent to prepare a sample for cutting. Then, this sample for cutting embedded in the resin is cut with a cutting device equipped with a diamond knife, for example, LEICA ultra-microtome (manufactured by Hitachi High Technology) at −100° C. to give a sample for observation. Then, the sample for observation is stained by leaving it in a ruthenium tetraoxide atmosphere in a desiccator. The degree of staining is judged visually based on the degree of staining of a simultaneously left tape. This stained sample can be observed at about 5000-fold magnification with TEM.

The toner sample has been stained with ruthenium tetraoxide, and thus the binding polymer and the release agent can be discriminated from differences in staining density and in shape. Portions with a whiter contrast present in clumps or in the form of a bar in clumps inside the toner were judged to be release agent domains.

Then, whether metal elements such as Al in the release agent domains are contained in the sample for observation was judged by mapping the metal elements in the release agent domains with an accelerating voltage of 20 kV with an energy dispersing X-ray spectrometer EMAX model 6923H (manufactured by Horiba Ltd.) fitted to an electron microscope S4100.

The content of Al in the release agent domains by fluorescent X-ray analysis is preferably from 0.01 or about 0.01 to 0.1 or about 0.1 atom %, more preferably from 0.01 or about 0.01 to 0.05 or about 0.05 atom %.

When the content of Al is less than 0.01 atom %, the crystal growth of the release agent may not be inhibited. On the other hand, when the content of Al is more than 0.1 atom %, the crystal growth of the release agent can be inhibited, however melting of the release agent is inhibited, thus making a transfer medium poor in releasability from a fixing member. Particularly, in low-temperature fixation or under the condition of a process speed of 500 mm/s, releasability is made particularly deteriorated and undesirable for the toner. When the content of Al in the release agent domains is in the above range, uneven gloss can be more effectively prevented after fixation.

In the exemplary embodiment, low-temperature fixation refers to fixation of the toner by heating at 120° C. or less.

Hereinafter, the respective components constituting the toner in the exemplary embodiment will be described.

The toner in the exemplary embodiment is composed of a polyester resin, a release agent and if necessary other additives.

(Polyester Resin)

The toner in the exemplary embodiment contains a polyester resin as a binding polymer. The type of the polyester resin is not particularly limited, and known crystalline polyester resin and noncrystalline polyester resin can be used. The crystalline polyester resin and noncrystalline polyester can be simultaneously used.

—Crystalline Polyester Resin—

In the exemplary embodiment, a crystalline polyester resin is preferably used for rapid change in viscosity by heating and from the viewpoint of attaining both mechanical strength and low-temperature fixability.

The term "crystallinity" in the crystalline polyester resin means that in differential scanning calorimetry (DSC), the resin does not show a stepwise endothermic change, but has a clear endothermic peak, specifically an endothermic peak having a half width of 10° C. or less when measured at a temperature increasing rate pf 10° C./min. On the other hand, a resin having a half width of more than 10° C. or a resin not recognized to have a clear endothermic peak means a noncrystalline resin (amorphous polymer) in the exemplary embodiment of the invention.

As a polymerizable monomer component composing the crystalline polyester resin, a polymerizable monomer having a straight-chain aliphatic component is more preferable than a polymerizable monomer having an aromatic component in order to readily form a crystal structure. Further, the content of the components derived from the polymerizable monomers in the polymer is preferably each 30% by mole or more as a single component for not impairing the crystallinity.

The melting temperature of the crystalline polyester resin used in the exemplary embodiment of the invention is preferably in the range of from 50 or about 50 to 100 or about 100° C., more preferably in the range of from 55 or about 55 to 90 or about 90° C., further preferably in the range of from 60 or about 60 to 85 or about 85° C. If the melting temperature is lower than 50° C., problems with toner storage property such as blocking of a stored toner may occur, and the storage property of the fixed image after fixing may be impaired. On the other hand, when the melting temperature is more than 100° C., sufficient low temperature fixability is not obtained.

The melting temperature of the crystalline polyester resin was determined as the peak temperature of the endothermic peak obtained by the differential scanning calorimetry (DSC) described above.

In the exemplary embodiment of the invention, the term "crystalline polyester resin" means a polymer composed of a 100% polyester structure, as well as a polymer in which a component composing polyester and other components are polymerized (copolymer). However, in the latter case, the content of the other components except for polyester composing the polymer (copolymer) is 50% by weight or less.

The crystalline polyester resin used in the toner of the exemplary embodiment of the invention is, for example, synthesized from a polyvalent carboxylic acid component and a polyhydric alcohol component. In the exemplary embodiment, a commercial product or a synthesized compound may be used as the crystalline polyester resin.

Examples of the polyvalent carboxylic acid component include, however not limited to, aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, or 1,18-octadecanedicarboxylic acid; aromatic dicarboxylic acids of dibasic acids such as phthalic acid, isophthalic acid, terephthalic acid, naphthalene-2,6-dicarboxylic acid, malonic acid, or mesaconic acid; and anhydrides and lower alkyl esters thereof.

Examples of the trivalent or more carboxylic acid include specific aromatic carboxylic acids such as 1,2,3-benzenetricarboxylic acid, 1,2,4-benzenetricarboxylic acid, and 1,2,4-naphthalenetricarboxylic acid, and anhydrides and lower alkyl esters thereof. These may be used alone or in combination of two or more of them.

As the acid component, in addition to the aliphatic dicarboxylic acid and aromatic dicarboxylic acid, a dicarboxylic acid component having a sulfonic acid group may be contained.

In addition to the aliphatic dicarboxylic acid and aromatic dicarboxylic acid, a dicarboxylic acid component having a double bond may be contained.

As the polyhydric alcohol component, an aliphatic diol is preferable, and a straight-chain aliphatic diol having 7 to 20 carbon atoms in the main chain thereof is more preferable. When the aliphatic diol is of branched type, the crystallinity of the polyester resin may be decreased, which result in the decrease of the melting temperature thereof. When the diol having less than 7 carbon atoms in the main chain thereof is polycondensed with an aromatic dicarboxylic acid, the melting temperature rises and the rise of the melting temperature makes low-temperature fixation difficult. On the other hand, when the carbon atoms in the main chain are more than 20, it tends to be difficult to obtain a practical material. The number of carbon atoms in the main chain is more preferably 14 or less.

Specific examples of aliphatic diols which are preferably used in the synthesis of the crystalline polyester used in the toner in the exemplary embodiment of the invention include, however are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, 1,8-octanediol, 1,9-nonanediol, and 1,10-decanediol are preferable in consideration of availability.

Examples of the trivalent or more alcohols include glycerol, trimethylolethane, trimethylolpropane, and pentaerythritol. These may be used alone or in combination of two or more of them.

In the polyhydric alcohol components, the content of the aliphatic dial is preferably 80% by mole or more, and more preferably 90% or more. If the content of aliphatic dial is less than 80% by mole, the crystallinity of the polyester resin decreases and the melting temperature decreases, which may deteriorate the toner blocking resistance, image storage stability, and low temperature fixability.

As needed, a polyvalent carboxylic acid or a polyhydric alcohol may be added in the final step of the synthesis for the purpose of adjusting the acid value or hydroxyl value. Examples of the polyvalent carboxylic acid include aromatic carboxylic acids such as terephthalic acid, isophthalic acid, phthalic anhydride, trimellitic anhydride, pyromellitic acid, or naphthalenedicarboxylic acid; aliphatic carboxyl acid such as maleic anhydride, fumaric acid, succinic acid, alkenyl succinic anhydride, or adipic acid; alicyclic carboxylic acids such as cyclohexane dicarboxylic acid; and aromatic carboxylic acids having at least 3 carboxyl groups in one molecule, such as 1,2,4-benzenetricarboxylic acid, 1,2,5-benzenetricarboxylic acid, or 1,2,4-naphthalenetricarboxylic acid.

Example of the polyhydric alcohol include aliphatic diols such as ethylene glycol, diethylene glycol, triethylene glycol, propylene glycol, butane diol, hexane diol, neopentyl glycol, or glycerol; alicyclic diols such as cyclohexane diol, cyclohexane dimethanol, or hydrogenated bisphenol A; and aromatic dials such as ethylene oxide adduct of bisphenol A or propylene oxide adduct of bisphenol A.

The crystalline polyester resin may be produced at a polymerization temperature of 180 to 230° C., and the reaction is carried out in a reaction system which is decompressed if necessary, while water and alcohol generated during condensation is being removed.

When a polymerizable monomer is insoluble or incompatible at the reaction temperature, a high boiling point solvent may be added as a solubilizing agent to dissolve the insoluble or incompatible polymerizable monomer. In this case, the polycondensation reaction is carried out with the solubilizing solvent being removed by evaporation. When a polymerizable monomer having poor compatibility is present in the copolymerization reaction, the polymerizable monomer having poor compatibility should be previously condensed with an acid or alcohol which is to be polycondensed with the polymerizable monomer, and then polycondensed with the main component.

Examples of the catalyst which may be used for producing the polyester resin include alkali metal compounds such as those of sodium or lithium; alkaline earth metal compounds such as those of magnesium or calcium; metal compounds such as those of zinc, manganese, antimony, titanium, tin, zirconium, or germanium; phosphorous acid compounds; phosphoric acid compounds; and amine compounds.

Specific examples of such catalysts include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tin tetraphenyl, dibutyltin dichloride, dibutyltin oxide, diphenyltin oxide, zirconium tetrabutoxide, zirconium naphthenate, zirconyl carbonate, zirconyl acetate, zirconyl stearate, zirconyl octoate, germanium oxide, triphenyl phosphite, tris(2,4-di-t-butylphenyl)phosphite, ethyltriphenyl phosphonium bromide, triethyl amine, triphenyl amine, and other compounds.

The acid value of the crystalline polyester resin used in the exemplary embodiment of the invention (the number of milligrams of KOH necessary to neutralize 1 g of resin) is preferably in the range of from 3.0 or about 3.0 to 30.0 or about 30.0 mg KOH/g, more preferably in the range of from 6.0 or about 6.0 to 25.0 or about 25.0 mg KOH/g, even more preferably in the range of from 8.0 or about 8.0 to 20.0 or about 20.0 mg KOH/g. In the exemplary embodiment, the acid value is measured in accordance with JIS K-0070-1992.

If the acid value is lower than 3.0 mg KOH/g, the preparation of the emulsification particles by a wet process may be significantly difficult because of the decrease of the dispersibility in water. Furthermore, the stability of the toner as emulsification particles during aggregation is significantly decreased, so it may thus be difficult to efficiently prepare the toner. On the other hand, if the acid value is more than 30.0 mg KOH/g, the moisture absorption property of the toner increases, and this may make the toner susceptible to environmental effects.

The weight average molecular weight (Mw) of the crystalline polyester resin is preferably from 6,000 or about 6,000 to 35,000 or about 35,000. If the molecular weight (Mw) is less than 6,000, the toner may penetrate into the surface of a recording medium such as paper during fixation to cause uneven fixation, or decrease the strength of the fixed image for bending resistance. On the other hand, if the weight average molecular weight (Mw) is more than 35,000, the viscosity upon fusion becomes so high that the temperature for achieving a viscosity suitable for fixation may increase, which may result in impairing the low temperature fixability.

The weight average molecular weight may be determined by gel permeation chromatography (GPC). The molecular weight determination by GPC was carried out using GPC-HLC-8120 as a measuring apparatus manufactured by Tosoh Corporation, with TSK gel Super HM-M (15 cm) as a column manufactured by Tosoh Corporation and THF as a solvent. The weight average molecular weight was calculated from the measurement result using a molecular weight calibration curve which had been prepared with a monodispersed polystyrene standard sample.

The content of the crystalline polyester resin in the toner is preferably in the range of from 3 or about 3 to 40 or about 40% by weight, more preferably in the range of from 4 or about 4 to 35 or about 35% by weight, even more preferably in the range of from 5 or about 5 to 30 or about 30% by weight.

The above crystalline polyester resin is preferably composed mainly of a polyester resin (also referred to hereinafter as "crystalline aliphatic polyester resin") which has been synthesized using an aliphatic polymerizable monomer (50% by weight or more). In this case, the constituent ratio of the aliphatic polymerizable monomer composing the above crystalline aliphatic polyester resin is preferably 60% by mole or more, and more preferably 90% by mole or more. As the aliphatic polymerizable monomer, the above-described aliphatic diols or dicarboxylic acids may be preferably used.

—Noncrystalline Polyester Resin—

When a noncrystalline polyester resin is used in the exemplary embodiment of the invention, compatibility with the crystalline polyester resin is improved. Therefore, along with the decrease in the viscosity of the crystalline polyester resin at the melting temperature, the viscosity of the noncrystalline polyester resin also decreases, and a sharp-melt property (a sharp melting property) as a toner is obtained, which is advantageous to low temperature fixability. Further, the noncrystalline polymer is excellent in wettability with a crystalline polyester resin, thus improving the dispersibility of the crystalline polyester resin into the toner to inhibit the exposure of the crystalline polyester resin at the surface of the toner, which inhibits the deleterious effect on the charging property. On this account, the resin is preferable also from the viewpoints of improvement of the strength of the toner and fixed image.

The noncrystalline polyester resin which is preferably used in the exemplary embodiment of the invention is obtained by, for example, polycondensation of polyvalent carboxylic acids with polyhydric alcohols.

Examples of the polyvalent carboxylic acid include aromatic carboxylic acids such as terephthalic acid, isophthalic acid, phthalic anhydride, trimellitic anhydride, pyromellitic acid, or naphthalenedicarboxylic acid; aliphatic carboxylic acids such as maleic anhydride, fumaric acid, succinic acid, alkenyl succinic anhydride, or adipic acid; and alicyclic carboxylic acids such as cyclohexanedicarboxylic acid. One or two or more of these polyvalent carboxylic acids may be used. Among these polyvalent carboxylic acids, it is preferable to use an aromatic carboxylic acid, and in order to form a crosslinking or branched structure for securing a favorable fixability, it is preferable to use a trivalent or more carboxylic acid (e.g., trimellitic acid or an anhydride thereof) in combination with a dicarboxylic acid.

Examples of the polyhydric alcohol in the noncrystalline polyester resin include aliphatic diols such as ethylene glycol, diethylene glycol, triethylene glycol, propylene glycol, butanediol, hexane dial, neopentyl glycol, or glycerol; alicyclic diols such as cyclohexane diol, cyclohexanedimethanol, or hydrogenated bisphenol A; and aromatic diols such as ethylene oxide adduct of bisphenol A or propylene oxide adduct of bisphenol A. One or two or more of these polyhydric alcohols may be used. Among these polyhydric alcohols, aromatic diols and alicyclic diols are preferable, and aromatic diols are more preferable. In order to form a crosslinking or branched structure for securing favorable fixability, it is preferable to use a trivalent or more polyhydric alcohol (glycerol, trimethylol propane, or pentaerythritol) in combination with a dial.

The glass transition temperature (Tg) of the noncrystalline polyester resin is preferably in the range of 50 to 80° C. If the Tg is lower than 50° C., problems may occur in the storage stability of the toner or the storage stability of the fixed image. On the other hand, if the Tg is higher than 80° C., fixation at a lower temperature than conventional methods may be impossible.

The Tg of the noncrystalline polyester resin is more preferably in the range of 50 to 65° C.

The glass transition temperature of the noncrystalline polyester resin can be determined as the peak temperature of an endothermic peak obtained by the differential scanning calorimeter (DSC) described above.

The content of the noncrystalline polyester resin in the toner is preferably in the range of 40 to 95% by weight, more preferably in the range of 50 to 90% by weight, even more preferably in the range of 60 to 85% by weight.

Production of the noncrystalline polyester resin can be carried out in accordance with the production of the crystalline polyester resin described above.

(Release Agent)

The toner in the exemplary embodiment of the invention contains a release agent. Examples of the release agent include paraffin wax such as low molecular weight polypropylene or low molecular weight polyethylene; silicone resin; rosins; rice wax; carnauba wax; ester wax; and montan wax. Among them, paraffin wax, ester wax, and montan wax are preferable, and paraffin wax and ester wax are more preferable. The melting temperature of the release agent used in the exemplary embodiment is preferably 60 to 130° C., more preferably 70 to 120° C. The content of the release agent in the toner is preferably from 0.5 or about 0.5 to 15 or about 15% by weight, more preferably from 1.0 or about 1.0 to 12 or about 12% by weight. If the content of the release agent is less than 0.5% by weight, a peeling defect may occur particularly in oilless fixing. If the content of the release agent is more than 15% by weight, the reliability of the image quality and image formation may be decreased due to the deterioration of the toner mobility and others.

(Other Additives)

The toner in this exemplary embodiment may further contain various components such as an internal additive, a charge controlling agent, inorganic particulate matter (inorganic particles), and organic particles as necessary in addition to the components described above.

Examples of the internal additive include metals such as ferrite, magnetite, reduced iron, cobalt, nickel, or manganese, alloys, and magnetic substances such as a compound containing these metals.

The inorganic particles are added for various purposes and may be added for regulation of the viscoelasticity of the toner. By regulating the viscoelasticity, image glossiness and penetration of the toner into paper can be regulated. As the inorganic particles, known inorganic particles such as silica particles, titanium oxide particles, alumina particles, and cerium oxide particles, and those whose surface is made hydrophobic may be used. One type of these inorganic particles may be used or two or more types of them can be used together. Among them, silica particles having a lower refractive index than that of the binding polymer are preferably used from the viewpoints of preventing deterioration in coloring properties and transparency such as OHP transmission. The silica particles may be subjected to various kinds of surface treatments. For example, silica particles whose surface is treated with a silane coupling agent, a titanium coupling agent, or silicone oil are preferably used.

(Properties of Toner)

In the exemplary embodiment of the invention, the volume average particle size of the toner is preferably in the range of from 4 or about 4 to 9 or about 9 μm, more preferably in the range of from 4.5 or about 4.5 to 8.5 or about 8.5 μm, even more preferably in the range of from 5 or about 5 to 8 or about 8 μm. If the volume average particle size is smaller than 4 μm, the toner mobility tends to decrease, the charging property of the particles tends to decrease, and fogging of the background, the spill of the toner from the developing device or the like tends to occur due to widening of the charging distribution. If the volume average particle size is smaller than 4 μm, the cleanability may be significantly problematic. When the volume average particle size is larger than 9 μm, the resolution deteriorates, and thus a sufficient image quality may not be achieved, and it may become difficult to satisfy the recent demand for a high quality image.

The volume-average particle size can be measured by COULTER MULTISIZER II (manufactured by Beckman Coulter, Inc.) with an aperture diameter of 50 μm. In this case, the toner is dispersed in an electrolyte aqueous solution (ISOTON aqueous solution) and dispersed for 30 seconds or more by ultrasonic wave prior to measurement.

The toner of the exemplary embodiment of the invention preferably has a spherical shape having a shape factor SF1 in the range of from 110 or about 110 to 140 or about 140. When the toner particle has a spherical shape in this range, the transfer efficiency and image denseness are improved, and an image of high quality is formed.

The shape factor SF1 is more preferably in the range of from 110 or 110 to 130 or about 130.

The shape factor SF1 is determined by the following formula (I):

$$SF1=(ML^2/A)\times(\pi/4)\times 100 \qquad \text{formula (1)}$$

wherein ML represents the absolute maximum length of the toner particles, and A represents the projected area of the toner particles.

The SF1 is converted into a number mainly by analyzing a microscope image or scanning electron microscope (SEM) image with an image analyzer, and calculated, for example, as follows. That is, an optical microscope image of toner particles distributed on the surface of a slide glass is taken in a Luzex image analyzer via a video camera, the maximum length and the projected area of 100 particles are measured, calculation is carried out by the formula (I), and the average is calculated to obtain the SF1.

The toner in the exemplary embodiment, together with at least one colored toner selected from the group consisting of a cyan toner, magenta toner, yellow toner and black toner, may constitute a toner set.

The colorant used in the colored toner may be a dye and/or a pigment, and is preferably a pigment from the viewpoints of light resistance and water resistance.

Preferable examples of the colorant that can be used include known pigments such as carbon black, aniline black, aniline blue, calco oil blue, chrome yellow, ultramarine blue, DuPont oil red, quinoline yellow, methylene blue chloride, phthalocyanine blue, malachite green oxalate, lamp black, rose bengal, quinacridone, benzidine yellow, C.I. Pigment Red 48:1, C.I. Pigment Red 57:1, C.I. Pigment Red 122, C.I. Pigment Red 185, C.I. Pigment Red 238, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1, and C.I. Pigment Blue 15:3.

The content of the colorant in the colored toner is preferably in the range of 1 to 30 parts by weight based on 100 parts by weight of the binding polymer. It is also effective to use a colorant whose surface is treated as necessary, or a pigment dispersant. By selecting the type of the colorant, a yellow toner, magenta toner, cyan toner, black toner or the like can be obtained.

The colored toner in the exemplary embodiment may contain the same components as in the toner (transparent toner) except that the colorant is contained. The ranges for the characteristics of the toner such as particle size are also the same as those of the toner in the exemplary embodiment.

<Method for Producing the Toner>

The method for producing the toner in the exemplary embodiment is not particularly limited, and the toner is prepared by a known process, for example a dry process such as kneading/milling process or a wet process such as an emulsion aggregation process or suspension polymerization. Among these processes, the emulsion aggregation process capable of easily preparing a toner having a low degree of exposure of the release agent at the surface of the toner with a core/shell structure is preferable. Hereinafter, the method for producing the toner in the exemplary embodiment by the emulsion aggregation process will be described in detail.

The method for producing the toner in the exemplary embodiment includes at least mixing a polyester resin particle dispersion liquid having polyester resin particles dispersed therein, with a release agent particle dispersion liquid having releasing particles dispersed therein obtained by mixing a release agent, an aggregating agent, and an acid component on which a structural unit derived from an acid component constituting the polyester resin is based, thereby forming aggregated particles containing the polyester resin particles and the release agent particles, and heating the aggregated particles thereby fusing the aggregated particles.

The polyester resin particles may be a combination of crystalline polyester resin particles and noncrystalline polyester resin particles.

The aggregating agent used in the release agent particle dispersion liquid includes, for example, inorganic metal salts containing metal elements such as Al.

Examples of the inorganic metal salts include metal salts such as calcium chloride, calcium nitrate, barium chloride, magnesium chloride, zinc chloride, aluminum chloride, or aluminum sulfate, and inorganic metal salt polymers such as polyaluminum chloride, polyhydroxy aluminum, or calcium polysulfide. Among them, aluminum salts and polymers thereof are particularly preferable.

By using the inorganic metal salt as an aggregating agent, its metal element is contained in the relating agent particles. As a result, a metal element such as Al is contained in the release agent domain of the toner.

The acid component on which a structural unit derived from an acid component constituting the polyester resin is based, is used in preparation of the release agent particle dispersion liquid, thereby allowing the acid component to be present within and on the release agent particles. By doing so, the affinity of the release agent particles for the polyester resin particles is improved, and in the step of forming the aggregated particles, the relating agent particles can be prevented from moving to the outside of the aggregated particles. As a result, the degree of exposure of the release agent at the surface of the toner is decreased.

When two or more structural units derived from the acid component are contained in the polyester resin, the acid component used in preparation of the release agent particle dispersion liquid may be an acid component on which one of the two or more structural units derived from the acid component is based.

In preparation of the release agent particle dispersion liquid, a release agent, an aggregating agent, and an acid component on which a structural unit derived from an acid component constituting the polyester resin is based, are dispersed in water, together with an ionic surfactant and a polymer electrolytes such as a high-molecular acid or a high-molecular base, and then heated to a temperature of the melting temperature or more of the release agent and simultaneously dispersed with a homogenizer or a pressure discharge disperser capable of applying strong shearing strength. By such treatment, a release agent particle dispersion liquid can be obtained.

The release agent particle dispersion liquid is used in the emulsion aggregation process, however when the toner is produced by the suspension polymerization method, the release agent particle dispersion liquid may be used.

By dispersion treatment, a release agent particle dispersion liquid containing release agent particles having a volume-average particle size of 1 μm or less is obtained. The volume-average article size of the release agent particles is more preferably 100 nm to 500 nm.

When the volume-average particle size is less than 100 nm, the release agent component, although being influenced by the characteristics of the used polyester resin, is generally hardly incorporated into the toner. When the volume-average particle size is more than 500 nm, the dispersed state of the release agent in the toner may become insufficient.

Preparation of the Polyester Resin Particle Dispersion Liquid can be Carried Out by applying shearing force, with a disperser, to a mixed solution of an aqueous medium and a polyester resin. On this occasion, the particles can be formed by reducing the viscosity of the resin component by heating. For stabilization of the dispersed resin particles, a dispersant may be used. When the polyester resin is oily and can be dissolved in a solvent having relatively low water solubility, the resin is dissolved in the solvent, and the particles of the resin, together with a dispersant and a polymer electrolyte, are then dispersed in water and then heated and depressurized to remove the solvent by evaporation, whereby a polyester resin particle dispersion liquid can be prepared.

The aqueous medium includes, for example, water such as distilled water or deionized water; and alcohols, and is preferably water alone.

Examples of the dispersant used in the emulsification step include water-soluble polymers such as polyvinyl alcohol, methyl cellulose, ethyl cellulose, hydroxyethyl cellulose, carboxymethyl cellulose, sodium polyacrylate, or sodium polymethacrylate; anionic surfactants such as sodium dodecylbenzenesulfonate, sodium octadecylsulfate, sodium oleate, sodium laurate, or potassium stearate, cationic surfactants such as laurylamine acetate, stearylamine acetate, or lauryltrimethyl ammonium chloride, amphoteric ionic surfactants such as lauryldimethylamine oxide, nonionic surfactants such as polyoxyethylene alkyl ether, polyoxyethylene alkylphenyl ether, or polyoxyethylene alkylamine; and inorganic salts such as tricalcium phosphate, aluminum hydroxide, calcium sulfate, calcium carbonate, or barium carbonate.

A disperser used for preparing the emulsion is exemplified by a homogenizer, a homomixer, a pressurization kneader, an extruder, or a media disperser. The size of the resin particles, in terms of average particle size (volume-average particle size), is preferably 1.0 μm or less, more preferably in the range of 60 to 300 nm, even more preferably in the range of 150 to 250 nm. When the particle size is less than 60 nm, the resin particles become stable particles in the dispersion, and thus the aggregation of the resin particles may become difficult. When the particle size is more than 1.0 μm, the ability of the resin particles to be aggregated is improved, thereby facilitating formation of toner particles, however the particle size distribution of the toner may be broadened.

(Aggregated Particle-Forming Step)

In the step of forming aggregated particles, the polyester resin particle dispersion liquid, the release agent particle dispersion liquid etc. are mixed to prepare a mixed solution, and the solution is heated at the glass transition temperature or less or melting temperature or less of the polyester resin particles to cause aggregation, and thus aggregated particles are formed. The formation of the aggregated particles is carried out by adjusting the pH of the mixed solution to the acidic range under stirring. The pH is preferably in the range of 2 to 7, more preferably in the range of 2.2 to 6, even more preferably in the range of 2.4 to 5. On this occasion, it is also effective to use an aggregating agent.

In the aggregation step, the release agent particle dispersion liquid may be added and mixed all at once or may be added plural times in divided portions.

As the aggregating agent to be used, a surfactant having a polarity opposite to the polarity of the surfactant used as the dispersant, as well as an inorganic metal salt, and a divalent or more metal complex are preferably used. In particular, a metal complex is particularly preferable because the amount of the surfactant used can be reduced and the charging property is improved.

Examples of the inorganic metal salt include metal salts such as calcium chloride, calcium nitrate, barium chloride, magnesium chloride, zinc chloride, aluminum chloride, or aluminum sulfate, and inorganic metal salt polymers such as polyaluminum chloride, polyhydroxy aluminum, or calcium polysulfide. Among them, aluminum salts and polymers thereof are particularly preferable. For obtaining a sharper particle size distribution, with regard to the valence of the inorganic metal salt, divalent is better than monovalent, trivalent is better than divalent and tetravalent is better than trivalent, and among those having the same valence, inorganic metal salt polymer of polymerization type is more suitable.

In the exemplary embodiment, a polymer of tetravalent inorganic metal salt containing aluminum is preferably used to attain sharp particle size distribution.

A toner composed of core aggregated particles whose surface is coated with noncrystalline resin particles may be prepared by additionally adding noncrystalline resin particles at the point when the aggregated particles have a desired particle size (coating step). By so doing, the release agent is hard to be exposed at the toner surface, so that the degree of exposure of the release agent at the surface of the toner can be reduced to 10% or less. When the noncrystalline polyester resin particles are additionally added, the addition of an aggregating agent or the adjustment of the pH may be previously carried out.

(Fusion Step)

In the fusion step, the pH of the suspension of the aggregated particles is increased to the range of 3 to 9 under the stirring conditions according to the aggregation step, thereby terminating the progress of the aggregation, and the aggregated particles are fused by heating at the glass transition temperature or more or melting temperature or more of the polyester resin particles. When the particles are coated with the noncrystalline polyester resin, the noncrystalline polyester resin is also fused to coat the core aggregated particles. The time for the heating should be enough for fusion, and about 0.5 to 10 hours will suffice.

Cooling is performed after fusion, and fused particles are obtained. Crystallization may be promoted by slowing down the cooling rate, so-called slow cooling, in the cooling step in the vicinity of the melting temperature of the crystalline polyester resin (in the range of melting temperature ±10°).

The fused particles obtained by fusion is subjected to a solid-liquid separation step such as filtration, and if necessary, a washing step, and a dry step to form toner particles.

—External Additive and Internal Additive—

For the purpose of charging regulation, conferring fluidity or conferring charge exchange, inorganic oxides represented by silica, titania and aluminum oxide can be added and adhered to the resulting toner particles. Mixing can be performed with the known mixing machine such as a V-type blender, a Henschel mixer, and a Ledige mixer, to adhere the inorganic oxides thereto in divided stages.

Examples of the inorganic particles include particles of silica, alumina, titanium oxide, barium titanate, magnesium titanate, calcium titanate, strontium titanate, zinc oxide, silica sand, clay, mica, wollastonite, diatomaceous earth, cerium chloride, red iron oxide, chromium oxide, cerium oxide, antimony trioxide, magnesium oxide, zirconium oxide, silicon carbide, and silicon nitride. Among them, silica particles and/or titania particles are preferable, and hydrophobicized silica particles and titania particles are particularly preferable.

The inorganic particles are used in general for the purpose of improving the flowability of the toner. Among the inorganic particles, metatitanic acid $TiO(OH)_2$ can be used to obtain a toner excellent in transparency and showing good charging property, environment stability, flowability, caking resistance, stable negative charging property, and stable image quality maintaining property. Moreover, it is preferable for the hydrophobic treated compound of metatitanic acid to have a $10^{10}$ Ω·cm or more electric resistance in order to obtain high transferability without generation of the toner charged to the opposite polarity even if the transfer electric field is raised. The volume average particle size of the external additive added for the purpose of conferring flowability is preferably in the range of 1 to 40 nm, more preferably in the range of 5 to 20 nm, in terms of primary particle size. The volume average particle size of the external additive added for the purpose of improving transferability is preferably in the range of 50 to 500 nm. These external additive particles are preferably used in surface improvements such as hydrophobation in order to stabilize chargeability and developability.

As the method for improving such surface improvements, conventionally known methods can be used. Specific examples include coupling treatments with a silane, a titanate, an aluminate, or the like. Preferable examples of the coupling agents used in these coupling treatments include, but are not limited to, silane coupling agents such as methyltrimethoxysilane, phenyltrimethoxysilane, methylphenyldimethoxysilane, diphenyldimethoxysilane, vinyltrimethoxysilane, γ-aminopropyltrimethoxysilane, γ-chloropropyltrimethoxysilane, γ-bromopropyltrimethoxysilane, γ-glycidoxypropyltrimethoxysilane, γ-mercaptopropyltrimethoxysilane, γ-ureidopropyltrimethoxysilane, fluoroalkyltrimethoxysilane and hexamethyldisilazane; titanate coupling agents; aluminate coupling agents; and the like.

Furthermore, various kinds of additives may be added as needed. These additives include other fluidizing agents, cleaning auxiliary agents such as polystyrene particles, polymethyl methacrylate particles, polyvinylidene fluoride particles, abrasive agents for the purpose of removing the photoreceptor adhered product such as zinc stearyl amide, strontium titanate, or the like.

The amount of the external additives added is preferably in the range of 0.1 to 5 parts by weight, more preferably in the range of 0.3 to 2 parts by weight, based on 100 parts by weight of the toner particles. When the amount of the external additives is less than 0.1 part by weight, the flowability of the toner may be deteriorated, and there arise undesirable problems such as deterioration in chargeability, deterioration in charge exchangeability, or the like. On the other hand, when the amount is more than 5 parts by weight, the toner particles become excessively covered with the external additives, so that the excessive inorganic oxide may move to the member in contact therewith, thus causing secondary troubles.

After the external additive is added, coarse particles of the toner may be removed if necessary, by using a ultrasonic sieve machine, a vibration sieve machine, a wind power sieve machine, or the like.

In addition to the external additives, other components (particles) such as a charge controlling agent, organic particles, a lubricant, and an abrasive agent may be added.

The charge controlling agent is not particularly limited. Particularly, a colorless or light-colored charge controlling agent can be preferably used. Examples of such charge controlling agents include quaternary ammonium salt compounds, nigrosine-based compounds, complexes of aluminum, iron, chromium, or the like, triphenylmethane-based pigments, or the like.

The organic particles include particles used ordinarily as an external additive for toner surface, such as vinyl resin, polyester resin, and silicone resin. These inorganic or organic particles can be used as a flowability auxiliary agent, a cleaning auxiliary agent, or the like.

The lubricant includes aliphatic amides such as ethylene bisstearic amide and oleic amide, aliphatic metal salts such as zinc stearate and calcium stearate, or the like.

The abrasive includes the above-mentioned silica, alumina, cerium oxide, or the like.

<Electrostatic Latent Image Developer>

The electrostatic latent image developer in the exemplary embodiment contains at least the toner in the exemplary embodiment.

The toner in the exemplary embodiment may be used as a one-component developer as it is or may be used in a two-component developer. When the toner is used in a two-component developer, it is mixed with a carrier to form a two-component developer.

The carrier usable in the two-component developer is not particularly limited, and any known carriers can be used. Examples thereof include magnetic metals such as iron oxide, nickel, and cobalt; magnetic oxides such as ferrite and magnetite; resin-coated carriers having a resin-coated layer on the surface of a core; and magnetic dispersion type carriers. The carrier may also be a resin dispersion carrier in which an electrically conductive material is dispersed in a matrix resin.

Examples of the coating resin or matrix resin used in the carrier include, however are not limited to, polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin having organosiloxane bonds, and a modified product thereof; fluororesin, polyester, polycarbonate, phenolic resin, and epoxy resin.

Examples of the electrically conductive material include, however are not limited to, metals such as gold, silver, and copper; carbon black; and titanium oxide, zinc oxide, barium sulfate, aluminum borate, potassium titanate, tin oxide, and carbon black. The conductive material is preferably a white electrically conductive material such as zinc oxide or titanium oxide. By using a white conductive material, carrier fragments are hardly noticed in a toner image upon transfer of the carrier fragments onto a transfer medium.

Examples of the core material of the carrier include magnetic metals such as iron, nickel, and cobalt; magnetic oxides such as ferrite and magnetite; and glass beads. The core material is preferably a magnetic substance when the carrier is used in a magnetic brush method. The volume-average particle size of the core of the carrier is generally in the range of 10 to 500 μm, preferably in the range of 30 to 100 μm.

In order to coat the surface of the core of the carrier with a resin, there is a method wherein a coating liquid for forming a resin layer, in which the coating resin and if necessary other optional additives are dissolved in an appropriate solvent, is applied to the surface of the core. The solvent is not particularly limited, and may be selected appropriately in consideration of the type of the coating resin used and/or suitability for coating.

Specific examples of the resin coating method include a dipping method in which the core of a carrier is dipped in a coating layer-forming solution; a spray method in which a coating layer-forming solution is sprayed onto the surface of the core of a carrier; a fluidized bed method in which a coating layer-forming solution is sprayed onto the core of the carrier that is being floated by fluidizing air; and a kneader coater method in which the core of a carrier is mixed with a coating layer-forming solution in a kneader coater followed by removing the solvent.

The mixing ratio (ratio by weight) of the toner in the exemplary embodiment to the carrier in the two-component developer is preferably in the range of about 1/100 to about 30/100 (toner/carrier), more preferably in the range of about 3/100 to about 20/100.

<Toner Cartridge, Process Cartridge and Image Forming Apparatus>

The image forming apparatus in the exemplary embodiment of the invention includes a latent image holding member, a charging unit that charges the latent image holding member, a latent image forming unit that forms an electrostatic latent image on a surface of the charged latent image holding member, a developing unit that develops the electrostatic latent image formed on the surface of the latent image holding member, as a toner image with the electrostatic latent image developer in the exemplary embodiment, an intermediate transfer medium to which the toner image formed on the surface of the latent image holding member is to be primarily transferred, a primary transfer unit that primarily transfers the toner image formed on the surface of the latent image holding member, onto the intermediate transfer medium, a secondary transfer unit that secondarily transfers the toner image transferred primarily on the intermediate transfer member, onto a transfer medium, and a fixing unit that fixes the toner image transferred on the transfer medium, and if necessary other units such as a cleaning unit that cleans transfer residual components on the latent image holding member.

In the image forming apparatus, for example, the portion including for example the developing unit may be a cartridge structure (process cartridge) which is attachable to and detachable from the main body of the image forming apparatus. As the process cartridge, the process cartridge in the exemplary embodiment of the invention including at least a developer holding member and accommodating the electrostatic latent image developer in the exemplary embodiment of the invention is preferably used.

Hereinafter, the image forming apparatus in the exemplary embodiment of the invention will be described in detail with reference to the drawing.

FIG. 1 is a skeleton framework showing one example of the image forming apparatus in the exemplary embodiment of the invention.

The image forming apparatus the exemplary embodiment, as shown in FIG. 1, is provided with 4 image forming units 50Y, 50M, 50C, and 50K for forming images of yellow, magenta, cyan, and black, respectively, and also with an image forming unit 50T for forming a transparent image. These image forming units are arranged in parallel in the horizontal direction with a predetermined distance apart from each other.

Since the image forming units 50Y, 50M, 50C, 50K, and 50T have the same structure except for the color of a toner in a developer accommodated therein, the image forming unit 50Y for forming a yellow image is described as a typical example. Descriptions of the image forming units 50M, 50C, 50K, and 50T are omitted by assigning the same reference numerals as the image forming unit SOY to the corresponding parts, wherein the numerals are followed by magenta (M), cyan (C), black (K), or transparent (T) in place of yellow (Y). In the exemplary embodiment, the toner in the exemplary embodiment is used as a toner (transparent toner) in the developer accommodated in the image forming unit 501

The yellow image forming unit 50Y has a photoreceptor 11Y as a latent image holding member, and the photoreceptor 11Y is driven to rotate at a predetermined process speed in the direction of arrow A by a driving unit (not shown). For example, an organic photoreceptor having sensitivity in the infrared range is used as the photoreceptor 11Y.

A charging roll (charging unit) 18Y is arranged above the photoreceptor 11Y, and a predetermined voltage is applied to the charging roll 18Y by a power supply (not shown), whereby the surface of the photoreceptor 11Y is charged at a predetermined potential. P Around the photoreceptor 11Y, an exposure device (latent image forming unit) 19Y for exposing the surface of the photoreceptor 11Y to form an electrostatic latent image is arranged downstream from the charging roll 18Y, in the direction of rotation of the photoreceptor 11Y. For the sake of space, the exposure device 19Y is a LED array that can be reduced in size, however the invention is not limited thereto, and a latent image forming unit by another laser beam or the like may be naturally used without any problem.

Around the photoreceptor 11Y, a developing device (developing unit) 20Y provided with a developer holding member for holding a yellow developer is arranged downstream from the exposure device 19Y, in the direction of rotation of the photoreceptor 11Y, and an electrostatic latent image formed on the surface of the photoreceptor 11Y is visualized with the yellow toner to form an toner image on the surface of the photoreceptor 11Y.

Below the photoreceptor 11Y, an intermediate transfer belt (intermediate transfer medium) 33 for primarily transferring the toner image formed on the surface of the photoreceptor 11Y is arranged so as to extend below the 5 photoreceptors 11T, 11Y, 11M, 11C, and 11K. The intermediate transfer belt 33 is pressed against the surface of the photoreceptor 11Y by the primary transfer roll 17Y. The intermediate transfer belt 33 is stretched with 3 rolls, that is, a drive roll 12, a support roll 13 and a bias roll 14, and moves in the direction of arrow B at the same movement speed as the process speed of the photoreceptor 11Y. Before the yellow toner image is primarily transferred as described above, a transparent toner image is primarily transferred onto the surface of the intermediate transfer belt 33, and then the yellow toner image is primarily transferred, and magenta, cyan and black toner images are successively primarily transferred and laminated thereon.

Around the photoreceptor 11Y, a cleaning device 15Y for cleaning up a toner remaining on the surface of the photoreceptor 11Y or for cleaning up a re-transferred toner is arranged downstream from the primary transfer roll 17Y, in the direction of rotation (direction of arrow A) of the photoreceptor 11Y. A cleaning blade in the cleaning device 15Y is attached so as to abut on the surface of the photoreceptor 11Y in the counter direction.

The bias roll 14 stretching and extending the intermediate transfer belt 33 is abutted on the intermediate transfer belt 33 against a secondary transfer roll (secondary transfer unit) 34. The toner images primarily transferred and laminated on the surface of the intermediate transfer belt 33 are electrostatically transferred at the abutting part between the bias roll 14 and the secondary transfer roll 34, onto the surface of recording paper (transfer medium) P fed from a paper cassette (not shown). In the toner images transferred and laminated on the intermediate transfer belt 33, the transparent toner image is placed undermost (placed in contact with the intermediate transfer belt 33), and thus the toner images are transferred onto the surface of the recording paper P such that the transparent toner image is placed uppermost.

A fixing device (fixing unit) 35 for fixing, by heat and pressure, the toner image multi-transferred on the recording paper P thereby forming a permanent image on the surface of the recording paper P is arranged downstream from the secondary transfer roll 34.

The fixing device used in the exemplary embodiment includes, for example, a belt-shaped fixing belt using, on the surface thereof, a low-surface-energy material represented by a fluorine resin component or a silicone resin, and a cylindrical fixing roll using, on the surface thereof, a low-surface-energy material represented by a fluorine resin component or a silicone resin.

Then, the working of the image forming units 50T, 50Y, 50M, 50C, and 50K for forming transparent, yellow, magenta, cyan and black images respectively will be described. Since the working of the image forming units 50T, 50Y, 50M, 50C, and 50K is the same, the working of the image forming unit 50Y for forming a yellow image is described as a typical example.

In the yellow developing unit SOY, the photoreceptor 11Y is rotated at a predetermined process speed in the direction of the arrow A. By the charging roll 18Y, the surface of the photoreceptor 11Y is negatively charged at a predetermined potential. Thereafter, the surface of the photoreceptor 11Y is exposed with the exposure device 19Y to form an electrostatic latent image in accordance with image information. Subsequently, the negatively charged toner is subjected to reversal development with the developing device 20Y, and the electrostatic latent image formed on the surface of the photoreceptor 11Y is visualized on the surface of the photoreceptor 11 to form a toner image. Thereafter, the toner image on the surface of the photoreceptor 11Y is primarily transferred with the primary transfer roll 17Y onto the surface of the intermediate transfer belt 33. After primary transfer, the photoreceptor 11Y is cleaned by scraping off transfer residual components such as a toner remaining on the surface, with a cleaning blade of the cleaning device 15Y, thus making the photoreceptor 11Y ready for a next image forming step.

The above working is performed by each of the image forming units 50T, SOY, 50M, 50C, and 50K, and the toner images visualized on the photoreceptors 11T, 11Y, 11M, 11C, and 11K are successively multi-transferred onto the surface of the intermediate transfer belt 33. At the time of color mode, toner images are multi-transferred in the order of transparent, yellow, magenta, cyan and black, and in this order, toner images of necessary colors are single- or multi-transferred at the time of two-color mode or three-color mode. Thereafter, the toner images thus single- or multi-transferred onto the surface of the intermediate transfer belt 33 are secondarily transferred onto the surface of recording paper P delivered with the secondary transfer roll 34 from a paper cassette (not shown), and are then fixed by heating and pressurization in a fixing device 35. The toner remaining on the surface of the intermediate transfer belt 33 after secondary transfer is cleaned off with a belt cleaner 16 composed of a cleaning blade for the intermediate transfer belt 33.

In FIG. 1, the yellow image forming unit 50Y is integrated with the developing device 20Y including a developer holding member for holding a yellow electrostatic latent image developer, the photoreceptor 11Y, the charging roll 18Y and the cleaning device 15Y, and thereby constituted as a process cartridge attachable to and detachable from the main body of the image forming apparatus. The image forming units 50T, 50K, 50C and 50M, similar to the image forming unit 50Y, are also constituted as process cartridges respectively.

Now, the toner cartridge in the exemplary embodiment is described. The toner cartridge in the exemplary embodiment is fitted detachably from and attachably to the image forming apparatus, and accommodates a toner to be fed to the developing unit arranged in the image forming apparatus. The toner cartridge in this exemplary embodiment may accommodate at least a toner and may, depending on the mechanism of the image forming apparatus, accommodate a developer for example.

Accordingly, in the image forming apparatus constituted such that the toner cartridge can be attached to and detached from it, the toner cartridge accommodating the toner in the exemplary embodiment can be used to provide the developing device easily with the toner in the exemplary embodiment.

The image forming apparatus shown in FIG. 1 is an image forming apparatus constituted such that the toner cartridges 40Y, 40M, 40C, 40K and 40T can be attached to and detached from it, and the developing devices 20Y, 20M, 20C, 20K and 20T are connected via toner-feeding pipes (not shown) to the toner cartridges corresponding to the respective developing devices (colors). When the toner accommodated in a toner cartridge is decreased, this toner cartridge can be exchanged with new one.

EXAMPLES

Hereinafter, the exemplary embodiment of the invention will be described in more detail by reference to the Examples, however the exemplary embodiment is not limited by these examples. The term "part" refers to "part by weight" unless otherwise specified.

(Preparation of Release agent Particle Dispersion Liquid (1))

Paraffin wax (trade name: FT115, manufactured by Nippon Seiro Co., Ltd., melting temperature 113° C.): 100 parts Anionic surfactant (trade name: NEOGEN RK, manufactured by Dai-ichi Kogyo Seiyaku Co., Ltd.): 1.0 part Polyaluminum chloride (PAC) (30% powdery product, manufactured by Oji Paper Co., Ltd.): 1.20 parts Terephthalic acid: 2 parts Deionized water: 400 parts The above components are mixed, heated to 95° C., dispersed using a homogenizer (trade name: ULTRA TURRAX T50, manufactured by IKA Co.), and subjected to dispersing treatment for 360 minutes with a Manton Gaulin high pressure homogenizer (Manton Gaulin Co.) to prepare a release agent particle dispersion liquid (1) (solid content: 20%) wherein release agent particles having a volume-average particle size of 0.23 μm are dispersed.

(Method of Measuring the Content of Metal Elements Contained in the Release Agent)

The release agent particle dispersion liquid is frozen with liquid nitrogen, followed by removing water with a vacuum drier, to form a powder.

6 g of the thus powdered release agent is subjected to compression molding as a pretreatment under pressurized conditions of 10 ton and 1 minute with a pressing molding apparatus and then measured for the compositional ratio (%) of metal elements in the whole elements by a whole-element analysis method using an X-ray fluorescence instrument (trade name; XRF-1500, manufactured by Shimadzu Corporation).

In this measurement, the X-ray tube voltage is 40 kV, and the X-ray tube current is 90 mA. The amount of Al in the release agent particle dispersion liquid (1) is 0.050 atom %.

(Preparation of Release agent Particle Dispersion Liquid (2))

Paraffin wax (trade name: FT115, manufactured by Nippon Seiro Co., Ltd., melting temperature 113° C.): 100 parts Anionic surfactant (trade name: NEOGEN RK, manufactured by Dai-ichi Kogyo Seiyaku Co., Ltd.): 1.0 part PAC (30% powdery product, manufactured by Oji Paper Co., Ltd.): 1.20 parts Fumaric acid: 2 parts Deionized water: 400 parts The above components are mixed, heated to 95° C., dispersed using a homogenizer (trade name: ULTRA TURRAX T50, manufactured by IKA Co.), and subjected to dispersing treatment for 360 minutes with a Manton Gaulin high pressure homogenizer (Manton Gaulin Co.) to prepare a release agent particle dispersion liquid (2) (solid content: 20%) wherein release agent particles having a volume-average particle size of 0.23 μm are dispersed. The amount of Al in the release agent particle dispersion liquid (2) is 0.050 atom %.

(Preparation of Release agent Particle Dispersion Liquid (3))

Paraffin wax (trade name: FT115, manufactured by Nippon Seiro Co., Ltd., melting temperature 113° C.): 100 parts Anionic surfactant (trade name: NEOGEN RK, manufactured by Dai-ichi Kogyo Seiyaku Co., Ltd.): 1.0 part PAC (30% powdery product, manufactured by Oji Paper Co., Ltd.): 0.79 part Terephthalic acid: 2 parts Deionized water: 400 parts The above components are mixed, heated to 95° C., dispersed using a homogenizer (trade name: ULTRA TURRAX T50, manufactured by TKA Co.), and subjected to dispersing treatment for 360 minutes with a Manton Gaulin high pressure homogenizer (Manton Gaulin Co.) to prepare a release agent particle dispersion liquid (3) (solid content: 20%) wherein release agent particles having a volume-average particle size of 0.23 μm are dispersed. The amount of Al in the release agent particle dispersion liquid (3) is 0.0059 atom %.

(Preparation of Release agent Particle Dispersion Liquid (4))

Paraffin wax (trade name: FT115, manufactured by Nippon Seiro Co., Ltd., melting temperature 113° C.): 100 parts Anionic surfactant (trade name: NEOGEN RK, manufactured by Dai-ichi Kogyo Seiyaku Co., Ltd.): 1.0 part PAC (30% powdery product, manufactured by Oji Paper Co., Ltd.): 0.79 part Deionized water: 200 parts The above components are mixed, heated to 95° C., dispersed using a homogenizer (trade name: ULTRA TURRAX T50, manufactured by IKA Co.), and subjected to dispersing treatment for 360 minutes with a Manton Gaulin high pressure homogenizer (Manton Gaulin Co.) to prepare a release agent particle dispersion liquid (4) (solid content: 20%) wherein release agent particles having a volume-average particle size of 0.23 μM are dispersed. The amount of Al in the release agent particle dispersion liquid (4) is 0.0065 atom %.

(Preparation of Release agent Particle Dispersion Liquid (5))

A release agent particle dispersion liquid (5) is obtained in the same manner as in the preparation of release agent particle dispersion liquid (1) except that the amount of PAC is changed to 0.82 part. The amount of Al in the obtained release agent particle dispersion liquid (5) is 0.0092 atom %.

(Preparation of Release agent Particle Dispersion Liquid (6))

A release agent particle dispersion liquid (6) is obtained in the same manner as in the preparation of release agent particle dispersion liquid (1) except that the amount of PAC is changed to 0.84 part. The amount of Al in the obtained release agent particle dispersion liquid (6) is 0.011 atom %.

(Preparation of Release agent Particle Dispersion Liquid (7))

A release agent particle dispersion liquid (7) is obtained in the same manner as in the preparation of release agent particle dispersion liquid (1) except that the amount of PAC is changed to 1.18 parts. The amount of Al in the obtained release agent particle dispersion liquid (7) is 0.048 atom %.

(Preparation of Release agent Particle Dispersion Liquid (8))

A release agent particle dispersion liquid (8) is obtained in the same manner as in the preparation of release agent particle dispersion liquid (1) except that the amount of PAC is changed to 1.64 parts. The amount of Al in the obtained release agent particle dispersion liquid (8) is 0.097 atom %.

(Preparation of Release agent Particle Dispersion Liquid (9))

A release agent particle dispersion liquid (9) is obtained in the same manner as in the preparation of release agent particle dispersion liquid (1) except that the amount of PAC is changed to 1.69 parts. The amount of Al in the obtained release agent particle dispersion liquid (9) is 0.103 atom %.

(Preparation of Release agent Particle Dispersion Liquid (10))

Paraffin wax (trade name: FT115, manufactured by Nippon Seiro Co., Ltd., melting temperature 113° C.): 100 parts Anionic surfactant (trade name: NEOGEN RK, manufactured by Dai-ichi Kogyo Seiyaku Co., Ltd.): 1.0 part Sodium chloride (manufactured by Wako Pure Chemical Industries, Ltd. extra pure regent (first grade)): 5 parts Terephthalic acid: 2 parts Deionized water: 400 parts The above components are mixed, heated to 95° C., dispersed using a homogenizer (trade name: ULTRA TURRAX T50, manufactured by IKA Co.), and subjected to dispersing treatment for 360 minutes with a Manton Gaulin high pressure homogenizer (Manton Gaulin Co.) to prepare a release agent particle dispersion liquid (10) (solid content: 20%) wherein release agent particles having a volume-average particle size of 0.20 μm are dispersed.

(Preparation of Release agent Particle Dispersion Liquid (11))

Paraffin wax (trade name: FT115, manufactured by Nippon Seiro Co., Ltd., melting temperature 113° C.): 100 parts Anionic surfactant (trade name: NEOGEN RK, manufactured by Dai-ichi Kogyo Seiyaku Co., Ltd.): 1.0 part Ferric chloride (manufactured by Wako Pure Chemical Industries, Ltd. extra pure regent (first grade)): 3 parts Terephthalic acid: 2 parts Deionized water: 400 parts The above components are mixed, heated to 95° C., dispersed using a homogenizer (trade name: ULTRA TURRAX T50, manufactured by IKA Co.), and subjected to dispersing treatment for 360 minutes with a Manton Gaulin high pressure homogenizer (Manton Gaulin Co.) to prepare a release agent particle dispersion liquid (11) (solid content: 20%) wherein release agent particles having a volume-average particle size of 0.21 μm are dispersed.

(Preparation of Release agent Particle Dispersion Liquid (12))

A release agent particle dispersion liquid (12) is obtained in the same manner as in the preparation of release agent particle dispersion liquid (1) except that the amount of terephthalic acid is changed to 1.0 part. The amount of Al in the obtained release agent particle dispersion liquid (12) is 0.050 atom %.

(Preparation of Release agent Particle Dispersion Liquid (13))

A release agent particle dispersion liquid (13) is obtained in the same manner as in the preparation of release agent particle dispersion liquid (1) except that the amount of terephthalic acid is changed to 1.1 parts. The amount of Al in the obtained release agent particle dispersion liquid (13) is 0.050 atom %.

(Preparation of Release agent Particle Dispersion Liquid (14))

A release agent particle dispersion liquid (14) is obtained in the same manner as in the preparation of release agent particle dispersion liquid (1) except that the amount of terephthalic acid is changed to 1.8 parts. The amount of Al in the obtained release agent particle dispersion liquid (14) is 0.050 atom %.

(Preparation of Release agent Particle Dispersion Liquid (15))

A release agent particle dispersion liquid (15) is obtained in the same manner as in the preparation of release agent particle dispersion liquid (1) except that the amount of terephthalic acid is changed to 0.3 part. The amount of Al in the obtained release agent particle dispersion liquid (15) is 0.050 atom %.

(Preparation of Release agent Particle Dispersion Liquid (16))

A release agent particle dispersion liquid (16) is obtained in the same manner as in the preparation of release agent particle dispersion liquid (1) except that the amount of terephthalic acid is changed to 0.4 part. The amount of Al in the obtained release agent particle dispersion liquid (16) is 0.050 atom %.

[Synthesis of Each Polyester Resin]

—Synthesis of Polyester Resin (1)—

Dimethyl adipate: 74 parts

Dimethyl terephthalate: 192 parts

Ethylene oxide adduct of bisphenol A: 216 parts

Ethylene glycol: 38 parts

Tetrabutoxy titanate (catalyst): 0.037 part

The above components are placed in a two-neck flask previously dried by heating, then a nitrogen gas is introduced into the flask, and under this inert atmosphere, the mixture is heated and then subjected to condensation copolymerization at 160° C. for 7 hours. Thereafter, the mixture is depressurized gradually to 10 Torr and simultaneously heated to 220° C., and kept at the same temperature for 4 hours. The reaction mixture is returned once to ordinary pressure, 9 parts of trimellitic anhydride is added to the reaction mixture which is then gradually depressurized again to 10 Torr and kept at 220° C. for 1 hour, thereby synthesizing polyester resin (1).

The glass transition temperature of the resulting polyester resin (1), as determined with a differential scanning calorimeter (DSC) by the measurement method described above, is 65° C. The weight-average molecular weight (Mw) and the number-average molecular weight (Mn) of the resulting polyester resin (1), as determined by GPC in accordance with the measurement method described above, are 12,000 and 4,000, respectively.

—Synthesis of Polyester Resin (2)—

Ethylene oxide (2 mol) adduct of bisphenol A: 114 parts

Propylene oxide (2 mol) adduct of bisphenol A: 84 parts

Dimethyl fumarate: 75 parts

Dodecenylsuccinic acid: 19.5 parts

Trimellitic acid: 7.5 parts

The above components are placed in a 5-L flask equipped with a stirrer, a nitrogen inlet tube, a temperature sensor and a rectifying column, and the temperature of the mixture is raised up to 190° C. over 1 hour. After the reaction system is uniformly stirred, 3.0 parts of dibutyltin oxide is poured into the mixture. While water formed is distilled away, the temperature of the mixture is raised from 190° C. to 240° C. over 6 hours and a dehydration condensation reaction is continued at 240° C. for another 2 hours, thereby synthesizing polyester resin (2).

The resulting polyester resin (2) has a glass transition temperature of 57° C., an acid value of 15.0 mg KOH/g, a weight-average molecular weight (Mw) of 58,000 and a number-average molecular weight (Mn) of 5,600.

[Preparation of Each Polyester Resin Particle Dispersion Liquid]

—Preparation of Polyester Resin Particle Dispersion Liquid (1)—

Polyester resin (1) (Mw: 12,000): 160 parts

Ethyl acetate: 233 parts

Aqueous solution of sodium hydroxide (0.3 N): 0.1 part

The above components are placed in a 1000-ml separable flask, heated at 70° C., and stirred with a Three-one motor (manufactured by Shinto Scientific Co., Ltd.), thereby preparing a resin mixed solution. While the resin mixed solution is further stirred, 373 parts of deionized water is slowly added to cause phase inversion emulsification, and the solvent is removed, thereby obtaining polyester resin particle dispersion liquid (1) (solid content: 30%). The volume-average particle size of the resin particles in the dispersion liquid is 160 nm.

—Preparation of Polyester Resin Particle Dispersion Liquid (2)—

Polyester resin particle dispersion liquid (2) (solid content: 30%) is prepared in the same manner as for the polyester resin particle dispersion liquid (1) except that the polyester resin (2) is used in place of the polyester resin (1). The volume-average particle size of the resin particles in the dispersion liquid is 160 nm.

Example 1

<Preparation of Toner>

Deionized water: 450 parts

Polyester resin particle dispersion liquid (1): 210 parts

Polyester resin particle dispersion liquid (2): 210 parts

Anionic surfactant (trade name: NEOGEN RK, 20% by weight, manufactured by Dai-Ichi Kogyo Seiyaku Co., Ltd.): 2.8 parts The above components are placed in a 3-L reaction container equipped with a thermometer, a pH meter and a stirrer, and then kept at 30° C. at a revolution number of 150 rpm for 30 minutes under temperature regulation with an external mantle heater. Thereafter, 100 parts of the release agent particle dispersion liquid (1) is introduced into the container and kept for 5 minutes. This mixture is adjusted to pH 3.0 with 1.0% by weight aqueous nitric acid in an aggregation step.

The mixture is dispersed using a homogenizer (trade name: ULTRATURRAX T50, manufactured by IKA Co.) while 0.4 part of polyaluminum chloride is added thereto. Then, the mixture is stirred and heated to 50° C. until the volume average particle size of the aggregated particles as determined by Coulter-Multisizer II (aperture diameter of 50 μm, manufactured by Beckman Coulter, Inc.) becomes 5.5 um. Thereafter, 110 parts of the polyester resin particle dispersion liquid (1) and 73 parts of the polyester resin particle dispersion liquid (2) are further added whereby the resin particles are adhered to the surfaces of the aggregated particles.

Thereafter, the pH of the mixture is adjusted to 9.0 with 5% by weight aqueous sodium hydroxide. Thereafter, the mixture is heated to 90° C. at an increasing temperature of 0.05° C./min. and kept at 90° C. for 3 hours, then cooled and filtered to give coarse toner particles. The toner particles are re-dispersed in deionized water and then filtered; this washing operation is conducted until the electric conductivity of the filtrate is reduced to 20 pS/cm or less. Then, the filtrate is vacuum-dried in an oven at 40° C. for 5 hours, to give toner particles.

100 parts of the resulting toner particles, 1.5 parts of hydrophobic silica (trade name: RY50, manufactured by Aerosil Co.) and 1.0 part of hydrophobic titanium oxide (trade name: T805, manufactured by Aerosil Co.) are mixed at 10000 rpm for 30 seconds by a sample mill. Thereafter, the sample is sieved with a vibrating sieve having 45-um openings, to prepare toner (1). The volume-average particle size of the resulting toner (1) is 6.1 μm.

<Preparation of Carrier>

14 parts of toluene, 2 parts of a styrene-methyl methacrylate copolymer (weight ratio: 80/20, weight-average molecular weight: 70000) and 0.6 part of zinc oxide (trade name: MZ500, manufactured by Titan Kogyo K.K.) are mixed and stirred for 10 minutes with a stirrer to prepare a coating layer-forming solution having zinc oxide dispersed therein. Then, this coating solution and 100 parts of ferrite particles (volume-average particle size: 38 μm) are placed in a vacuum degassing kneader, then stirred at 60° C. for 30 minutes and depressurized and degassed under heating and thereby dried to prepare a carrier.

<Preparation of Electrostatic Latent Image Developer>

The obtained carrier and the toner (1) are mixed in a ratio of 100 parts:8 parts in a 2-L V-blender to prepare an electrostatic latent image developer (1).

<Evaluation>

—Difference Between Tm and Tc—

The difference between Tm and Tc of the toner (1) is measured by the method described above. The obtained results are shown in Table 1.

—Degree of Exposure of the Release Agent—

The degree of exposure of the release agent in the toner (1) is quantitatively determined by C1S peak separation in X-ray photoelectron spectroscopy (XPS). The obtained results are shown in Table 1.

—Uneven Gloss—

Figure 2:
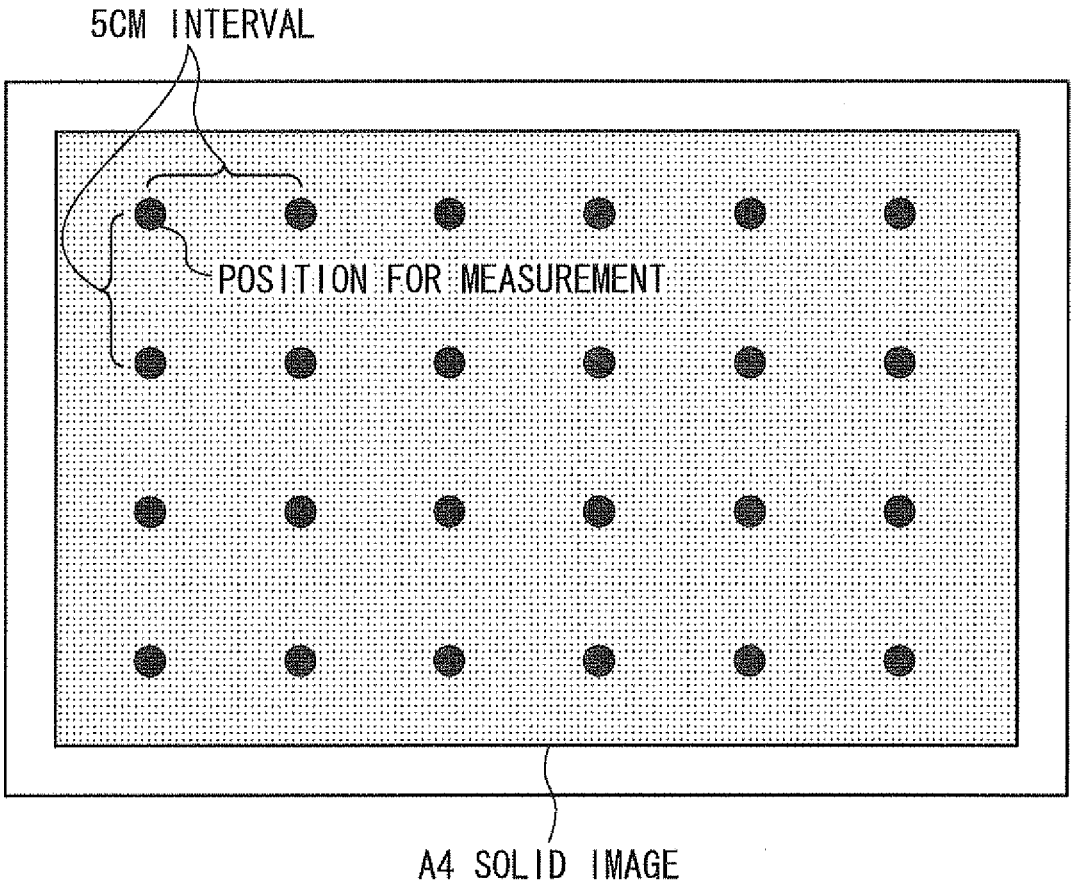
FIG. 2 is a diagram showing positions for measurement of glossiness in the Examples.

The electrostatic latent image developer (1) is loaded in a developing device of 5-tandem type modified machine of DocuCentre-III C7600 (5-tandem type modified machine for both side printing, manufactured by Fuji Xerox Co., Ltd.) shown in FIG. 1, and used to form a solid image (18 cm×27 cm) on both sides in A4 size of a recording paper (OK top coat+paper, manufactured by Oji Paper Co., Ltd.) at a fixing temperature of 190° C. The image portion of the formed solid image is measured for its 60° gloss at 24 points (points arranged at a longitudinal/crosswise 5-cm interval in the form of a matrix) of the solid image on the preceding face as shown in FIG. 2, with a gloss meter (BYK Micro-Trigloss Glossmeter (20+60+85°) manufactured by Gardner). From the difference in glossiness (maximum minus minimum), uneven gloss is evaluated. The evaluation criteria are as shown below. The results are shown in Table 1. The preceding face is the face of the paper to be fixed first in both side printing.

—Evaluation Criteria of Uneven Gloss—

A: The difference in glossiness is less than 5% and simultaneously the standard deviation at the 24 gloss measurement points is 2.5 or less.

B: The difference in glossiness is less than 5%.

C: The difference in glossiness is 5% or more and less than 10%.

D: The difference in glossiness is 10% or more.

—Pollution of Intermediate Transfer Medium—

The electrostatic latent image developer (1) is loaded in a developing device of DocuCentre-III C7600 manufactured by Fuji Xerox Co., Ltd. and left in an environment of 28° C./85% RH for 24 hours. Thereafter, the amount of the toner is regulated in an amount of 4.5 g/cm$^2$ in a solid image on a recording paper (OK top coat+paper, manufactured by Oji Paper Co., Ltd.), while a solid image is formed on 10000 sheets of paper. The intermediate transfer medium is visually confirmed per 500 sheets of paper so that the pollution of the intermediate transfer medium is evaluated under the following evaluation criteria. The obtained results are shown in Table 1. The evaluation criteria are as shown below.

A: No pollution is recognized up to 10000 sheets.

B: Slight pollution is recognized on the 10000th sheet, however gives no practical problem.

C: Pollution is recognized before the 10000th sheet and is not allowable.

—Generation of White Spots—

The electrostatic latent image developer (1) is loaded in a developing device of DocuCentre-III C7600 manufactured by Fuji Xerox Co., Ltd. and left in an environment of 28° C./85% RH for 24 hours. Thereafter, the amount of the toner is regulated in an amount of 4.5 g/cm$^2$ in a solid image on a recording paper (OK top coat+paper, manufactured by Oji Paper Co., Ltd.), while a solid image is formed on 10000 sheets of paper. The formed images are visually confirmed per 500 sheets so that generation of white spots is evaluated under the following evaluation criteria. The obtained results are shown in Table 1. The evaluation criteria are as shown below.

A: No white spot is recognized up to 10000 sheets.

B: Slight white spots are recognized on the 10000th sheet, however give no practical problem.

C: White spots are recognized before the 10000th sheet and are not allowable.

Example 2

A toner (2) and an electrostatic latent image developer (2) are obtained in the same manner as in Example 1 except that the release agent particle dispersion liquid (2) is used in place of the release agent particle dispersion liquid (1). The toner (2) and the electrostatic latent image developer (2) are evaluated in the same manner as in Example 1. The obtained results are shown in Table 1.

Example 3

A toner (5) and an electrostatic latent image developer (5) are obtained in the same manner as in Example 1 except that the release agent particle dispersion liquid (5) is used in place of the release agent particle dispersion liquid (1). The toner (5) and the electrostatic latent image developer (5) are evaluated in the same manner as in Example 1. The obtained results are shown in Table 1.

Example 4

A toner (6) and an electrostatic latent image developer (6) are obtained in the same manner as in Example 1 except that the release agent particle dispersion liquid (6) is used in place of the release agent particle dispersion liquid (1). The toner (6) and the electrostatic latent image developer (6) are evaluated in the same manner as in Example 1. The obtained results are shown in Table 1.

Example 5

A toner (7) and an electrostatic latent image developer (7) are obtained in the same manner as in Example 1 except that the release agent particle dispersion liquid (7) is used in place of the release agent particle dispersion liquid (1). The toner (7) and the electrostatic latent image developer (7) are evaluated in the same manner as in Example 1. The obtained results are shown in Table 1.

Example 6

A toner (8) and an electrostatic latent image developer (8) are obtained in the same manner as in Example 1 except that the release agent particle dispersion liquid (8) is used in place of the release agent particle dispersion liquid (1). The toner (8) and the electrostatic latent image developer (8) are evaluated in the same manner as in Example 1. The obtained results are shown in Table 1.

Example 7

A toner (9) and an electrostatic latent image developer (9) are obtained in the same manner as in Example 1 except that the release agent particle dispersion liquid (9) is used in place of the release agent particle dispersion liquid (1). The toner (9) and the electrostatic latent image developer (9) are evaluated in the same manner as in Example 1. The obtained results are shown in Table 1.

Example 8

A toner (10) and an electrostatic latent image developer (10) are obtained in the same manner as in Example 1 except that the release agent particle dispersion liquid (10) is used in place of the release agent particle dispersion liquid (1). The toner (10) and the electrostatic latent image developer (10) are evaluated in the same manner as in Example 1. The obtained results are shown in Table 1.

Example 9

A toner (11) and an electrostatic latent image developer (11) are obtained in the same manner as in Example 1 except that the release agent particle dispersion liquid (11) is used in place of the release agent particle dispersion liquid (1). The toner (11) and the electrostatic latent image developer (11) are evaluated in the same manner as in Example 1. The obtained results are shown in Table 1.

Example 10

A toner (14) and an electrostatic latent image developer (14) are obtained in the same manner as in Example 1 except that the release agent particle dispersion liquid (14) is used in place of the release agent particle dispersion liquid (1). The toner (14) and the electrostatic latent image developer (14) are evaluated in the same manner as in Example 1. The obtained results are shown in Table 1.

Example 11

A toner (13) and an electrostatic latent image developer (13) are obtained in the same manner as in Example 1 except that the release agent particle dispersion liquid (13) is used in place of the release agent particle dispersion liquid (1). The toner (13) and the electrostatic latent image developer (13)

are evaluated in the same manner as in Example 1. The obtained results are shown in Table 1.

Example 12

A toner (12) and an electrostatic latent image developer (12) are obtained in the same manner as in Example 1 except that the release agent particle dispersion liquid (12) is used in place of the release agent particle dispersion liquid (1). The toner (12) and the electrostatic latent image developer (12) are evaluated in the same manner as in Example 1. The obtained results are shown in Table 1.

Example 13

A toner (16) and an electrostatic latent image developer (16) are obtained in the same manner as in Example 1 except that the release agent particle dispersion liquid (16) is used in place of the release agent particle dispersion liquid (1). The toner (16) and the electrostatic latent image developer (16) are evaluated in the same manner as in Example 1. The obtained results are shown in Table 1.

Comparative Example 1

A toner (3) and an electrostatic latent image developer (3) are obtained in the same manner as in Example 1 except that the release agent particle dispersion liquid (3) is used in place of the release agent particle dispersion liquid (1). The toner (3) and the electrostatic latent image developer (3) are evaluated in the same manner as in Example 1. The obtained results are shown in Table 1.

Comparative Example 2

A toner (4) and an electrostatic latent image developer (4) are obtained in the same manner as in Example 1 except that the release agent particle dispersion liquid (4) is used in place of the release agent particle dispersion liquid (1). The toner (4) and the electrostatic latent image developer (4) are evaluated in the same manner as in Example 1. The obtained results are shown in Table 1.

Comparative Example 3

A toner (15) and an electrostatic latent image developer (15) are obtained in the same manner as in Example 1 except that the release agent particle dispersion liquid (15) is used in place of the release agent particle dispersion liquid (1). The toner (15) and the electrostatic latent image developer (15) are evaluated in the same manner as in Example 1. The obtained results are shown in Table 1.

TABLE 1

| | Toner and Developer No. | Difference between Tm and Tc | Degree of exposure of the release agent | Uneven gloss | Pollution of the intermediate transfer medium | Generation of white spots |
|---|---|---|---|---|---|---|
| Example 1 | 1 | 47 | 2.0 | A | A | A |
| Example 2 | 2 | 43 | 3.0 | B | A | A |
| Example 3 | 5 | 40 | 2.2 | C | A | A |
| Example 4 | 6 | 41 | 2.2 | B | A | A |
| Example 5 | 7 | 45 | 2.1 | B | A | A |
| Example 6 | 8 | 48 | 2.0 | A | A | A |
| Example 7 | 9 | 48 | 2.0 | A | A | A |
| Example 8 | 10 | 42 | 2.0 | B | A | A |
| Example 9 | 11 | 44 | 2.0 | B | A | A |
| Example 10 | 14 | 47 | 2.4 | A | A | A |
| Example 11 | 13 | 47 | 4.9 | A | A | A |
| Example 12 | 12 | 47 | 5.5 | A | B | A |
| Example 13 | 16 | 47 | 9.5 | A | B | B |
| Comparative Example 1 | 3 | 33 | 5 | D | B | B |
| Comparative Example 2 | 4 | 2 | 15.0 | D | C | C |
| Comparative Example 3 | 16 | 47 | 11.1 | A | B | C |

What is claimed is:

1. A transparent toner for electrostatic latent image development, comprising a polyester resin and a release agent, the difference between an endothermic peak Tm of the release agent in a temperature increasing process and an exothermic peak Tc of the release agent in a temperature decreasing process when measured by an ASTM method with a differential scanning calorimeter (DSC) is from about 40° C. to about 50° C., and the degree of exposure of the release agent at the surface of the toner as determined quantitatively by X-ray photoelectron spectroscopy (XPS) is about 10% or less of the surface area of the toner, wherein Al is present in the inside of a release agent domain of the transparent toner.

2. The transparent toner for electrostatic latent image development of claim 1, wherein the content of colorant is about 0.01% by weight or less of the toner.

3. The transparent toner for electrostatic latent image development of claim 1, wherein the content of Al in the release agent domain by fluorescent X-ray analysis is from about 0.01 atom % to about 0.1 atom %.

4. The transparent toner for electrostatic latent image development of claim 1, wherein the polyester resin comprises a crystalline polyester resin.

5. The transparent toner for electrostatic latent image development of claim 4, wherein the melting temperature of the crystalline polyester resin is from about 50° C. to about 100° C.

6. The transparent toner for electrostatic latent image development of claim 4, wherein the acid value of the crystalline polyester resin is from about 3.0 mg KOH/g to about 30.0 mg KOH/g.

7. The transparent toner for electrostatic latent image development of claim 4, wherein the weight average molecular weight (Mw) of the crystalline polyester resin is from about 6,000 to about 35,000.

8. The transparent toner for electrostatic latent image development of claim 4, wherein the content of the crystalline polyester resin in the toner is from about 3% by weight to about 40% by weight.

9. The transparent toner for electrostatic latent image development of claim 1, wherein the content of the release agent in the toner is from about 0.5% by weight to about 15% by weight.

10. The transparent toner for electrostatic latent image development of claim 1, wherein the volume average particle size of the toner is from about 4 μm to about 9 μm.

11. The transparent toner for electrostatic latent image development of claim 1, wherein a shape factor SF1 of the toner is from about 110 to about 140.

12. A method for producing a transparent toner for electrostatic latent image development, which comprises at least:

mixing a polyester resin particle dispersion liquid having polyester resin particles dispersed therein, with a release agent particle dispersion liquid having release agent particles dispersed therein obtained by mixing a release agent, an inorganic metal salt including Al as an aggregating agent, and an acid component on which a structural unit derived from an acid component constituting the polyester resin is based, thereby forming aggregated particles containing the polyester resin particles and the release agent particles, and heating the aggregated particles, thereby fusing the aggregated particles.

13. An electrostatic latent image developer comprising the transparent toner for electrostatic latent image development of claim 1 and a carrier.

14. The electrostatic latent image developer according to claim 13, wherein the carrier comprises an electrically conductive material in a coated layer.

15. The electrostatic latent image developer according to claim 14, wherein the electrically conductive material is a white electrically conductive material.

16. The electrostatic latent image developer according to claim 15, wherein the white electrically conductive material is titanium oxide.

17. The transparent toner for electrostatic latent image development of claim 1, wherein the toner is produced by a method that comprises (i) preparing a release agent dispersion by mixing the release agent with an inorganic metal salt including Al as an aggregating agent and an acid component on which a structural unit of the polyester resin is based, (ii) forming aggregated particles containing release agent particles and polyester resin particles by mixing the release agent dispersion with a dispersion of the polyester resin, and (iii) fusing the aggregated particles by heating.

* * * * *